US011614222B2

(12) United States Patent
Bai

(10) Patent No.: US 11,614,222 B2
(45) **Date of Patent: *Mar. 28, 2023**

(54) MULTIFUNCTIONAL LAMP

(71) Applicant: Ningbo Jinghui Opto-Electronic Co., Ltd., Zhejiang Province (CN)

(72) Inventor: Guohui Bai, Zhejiang Province (CN)

(73) Assignee: Ningbo Jinghui Opto-Electronic Co., Ltd., Zhejiang Province (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/409,597

(22) Filed: Aug. 23, 2021

(65) Prior Publication Data

US 2022/0178524 A1 Jun. 9, 2022

Related U.S. Application Data

(63) Continuation of application No. 17/148,157, filed on Jan. 13, 2021, now Pat. No. 11,125,422.

(30) Foreign Application Priority Data

Dec. 3, 2020 (CN) ..... 202022887286.3

(51) Int. Cl.

| | |
|---|---|
| ***F21V 21/088*** | (2006.01) |
| ***F21V 15/02*** | (2006.01) |
| ***F21V 23/06*** | (2006.01) |
| ***F21V 15/01*** | (2006.01) |
| ***F21V 17/18*** | (2006.01) |
| ***F21V 17/20*** | (2006.01) |

(52) U.S. Cl.

CPC ..... *F21V 21/0885* (2013.01); *F21V 15/02* (2013.01); *F21V 23/06* (2013.01); *F21V 15/01* (2013.01); *F21V 17/18* (2013.01); *F21V 17/20* (2013.01)

(58) Field of Classification Search

CPC ..... F21V 21/0885; F21V 15/02; F21V 23/06; F21V 15/01; F21V 17/18; F21V 17/20

USPC ..... 362/362, 374, 375, 376

See application file for complete search history.

(56) References Cited

U.S. PATENT DOCUMENTS 4,141,062 A * 2/1979 Trueblood ..... F21V 29/15 362/186
4,275,435 A * 6/1981 Dorn ..... F21V 15/02 362/396
4,369,487 A * 1/1983 Carlow ..... F21L 14/02 362/399

(Continued)

*Primary Examiner* — Lau K Tso

(74) *Attorney, Agent, or Firm* — Wood, Phillips, Katz, Clark & Mortimer

(57) ABSTRACT

The present patent discloses a multifunctional lamp, which comprises a base, a luminous body detachably connected with the base, and a supporting device and a protective cover respectively matched and connected with the base; the base is provided with a socket and a plug; a latch member is arranged between the base and the protective cover; through the latch member, the base and the protective cover can be quickly disassembled and assembled. The lamp of the present patent integrates the functions of a working lamp and a linear lamp, and has various functions; the connection between the base and the protective cover adopts a cylindrical latch structure, it is easy to disassemble and assemble, and is easy to operate.

10 Claims, 3 Drawing Sheets

(56) References Cited

U.S. PATENT DOCUMENTS

| | | | | |
|---|---|---|---|---|
| 5,528,477 | A * | 6/1996 | Carmo | F21V 15/02 362/396 |
| 5,695,278 | A * | 12/1997 | Grossman | F21V 15/02 362/399 |
| 6,902,303 | B2 * | 6/2005 | Lee | F21V 15/02 362/399 |
| 11,125,422 | B1 * | 9/2021 | Bai | F21V 23/06 |
| 2009/0097250 | A1 * | 4/2009 | Leasure | H01M 10/44 362/253 |
| 2022/0178523 | A1 * | 6/2022 | Bai | F21V 21/0885 |

* cited by examiner

MULTIFUNCTIONAL LAMP

TECHNICAL FIELD

The present patent relates to the technical field of lamps, in particular to a multifunctional lamp.

BACKGROUND ART

At present, the lamps on the market can only be used individually either as working lamps or linear lamps, and serve a single function; Due to the luminous body on a working lamp or a linear lamp is fixedly connected to the body, it cannot be replaced. If the luminous body is damaged, the whole lamp has to be replaced. The overall replacement cost is high. In addition, it is not easy to disassemble and assemble between the body and the protective cover.

SUMMARY OF THE PATENT

The technical problems to be solved by the present patent is to overcome the technical defects of the background art and provides a multifunctional lamp. The lamp of the present patent integrates the functions of a working lamp and a linear lamp, and has various functions. Further, as the luminous body and the base are detachably connected, the user can replace different luminous bodies according to their preferences, with high flexibility. In addition, when the luminous body is damaged, only to replace the luminous body separately, and this saves cost. Apart from this, as the connection between the base and the protective cover adopts a cylindrical latch structure, it is easy to disassemble and assemble, and is easy to operate.

The technical solutions adopted by the present patent to solve the above technical problems are as follows:

A multifunctional lamp, which comprises a base, a luminous body detachably connected with the base, and a supporting device and a protective cover respectively matched and connected with the base. The base is provided with a socket and a plug, thus enabling the multifunctional lamp to be used as a linear lamp. A latch member is arranged between the base and the protective cover. Through the supporting device, the multifunctional lamp can be placed on the ground, so that the multifunctional lamp can be used as a working lamp. Through the latch member, the base and the protective cover can be quickly disassembled and assembled.

The lamp of the present patent integrates the functions of a working lamp and a linear lamp, and has various functions. Further, as the luminous body and the base are detachably connected, the user can replace different luminous bodies according to their preferences, with high flexibility. In addition, when the luminous body is damaged, only to replace the luminous body separately, and this saves cost. Apart from this, as the connection between the base and the protective cover adopts a latch member structure, it is easy to disassemble and assemble, and is easy to operate.

Further, the latch member is a cylindrical latch.

Further, the base includes a lampshade and a bottom shell matched and connected with the lampshade; the lampshade is accommodated in the bottom shell; a lamp holder is arranged inside the bottom shell; the lamp holder is matched and connected with the lampshade; the luminous body is installed on the lamp holder.

Further, the lamp holder is a screw port holder; the screw port is an E26 screw port.

Further, an upper cover plate is provided on the top of the lampshade; a lower cover plate is provided on the top of the bottom shell corresponding to the upper cover plate; a first clamping block and a second clamping block are arranged in circumferential opposite directions on the upper cover plate; the first clamping block is provided with a first clamping slot; the second clamping block is provided with a second clamping slot; the opening direction of the first clamping slot faces away from the center of the upper cover; the opening direction of the second clamping slot faces the center of the upper cover plate; the protective cover includes a number of support rods arranged circumferentially, and a number of rings that are matched and connected with the support rods; the bottom rings are matched and clamped with the first clamping slot and the second clamping slot; a first counterbore is provided on the side of the opening of the first clamping slot; the lower cover plate corresponding to the first counterbore is provided with a second counterbore; the cylindrical latch passes through the first counterbore and the second counterbore, blocking the bottom rings.

Through the above arrangement, the protective cover can be firmly fixed to the base. In addition, in the process of replacing the luminous body, since the connection between the protective cover and the base adopts a cylindrical latch structure, it is easy to disassemble and assemble, and the operation is simple.

Further, one end of the cylindrical latch is provided with a stop ring; the top of the stop ring is limited to the bottom of the first counterbore; one end of the spring is limited to the bottom of the stop ring, and the other end is limited to the top of the second counterbore; the bottom of the cylindrical latch is provided with an operating ring.

Through the above arrangement, the disassembly and assembly of the protective cover and the base is more convenient.

Further, a plurality of limiting grooves matched with the bottom of the supporting rod are provided in the circumferential direction of the upper cover plate.

Further, a first stop block and a second stop block matching to the bottom rings are provided on the upper cover plate in the circumferential direction. The first stop block is provided with a first stop groove. The second stop block is provided with a second stop groove.

Through the above arrangement, the connection between the protective cover and the base is more stable.

Further, the socket and the plug are respectively arranged on both sides of the bottom shell. A dust cover is arranged on the outside of the socket, serving the function of dust prevention.

Further, a buckle is provided on the outer side of the dust cover, to prevent falling off when the socket is connected with the plug.

Further, a hoisting device and the supporting device are respectively arranged on the bottom of the bottom shell. The hoisting device is a carabiner; and the supporting device is a bracket. With the hoisting device, the multifunctional lamp can be hoisted.

Further, the bracket is an inverted U-shaped bracket.

Compared with the prior art, the beneficial effects of the present patent are:

The lamp of the present patent integrates the functions of a working lamp and a linear lamp, and has various functions. Further, as the luminous body and the base are detachably connected, the user can replace different luminous bodies according to their preferences, with high flexibility. In addition, when the luminous body is damaged, only to replace the luminous body separately, and this saves cost.

Apart from this, as the connection between the base and the protective cover adopts a cylindrical latch structure, it is easy to disassemble and assemble, and is easy to operate.

DESCRIPTION OF ACCOMPANIED FIGURES

The corresponding reference numeral parts in the accompanied figures are.

1—base; 11—socket; 12—plug; 13—lampshade; 131—upper cover plate; 132—first clamping block; 1321—first clamping slot; 133—second clamping block; 1331—second clamping slot; 134—first counterbore; 135—limiting grooves; 136—first stop block; 1361—first stop groove; 137—second stop block; 1371—second stop groove; 14—bottom shell; 141—lower cover plate; 142—second counterbore; 15—lamp holder; 2—supporting device; 3—hoisting device; 4—protective cover; 41—support rods; 42—rings; 5—cylindrical latch; 51—stop ring; 52—spring; 53—operating ring; 6—dust cover; 7—buckle.

DETAILED IMPLEMENTATION METHOD

In order to better understand the content of the present patent, further description will be given below in conjunction with specific embodiments and accompanied figures. It should be understood that these embodiments are only used to further illustrate the present patent, and are not used to limit the scope of the present patent. In addition, it should be understood that after reading the content of the present patent, any non-essential changes or adjustments to the present patent by those skilled in the art shall still belong to the protection scope of the present patent.

Embodiment 1

Figure 1:
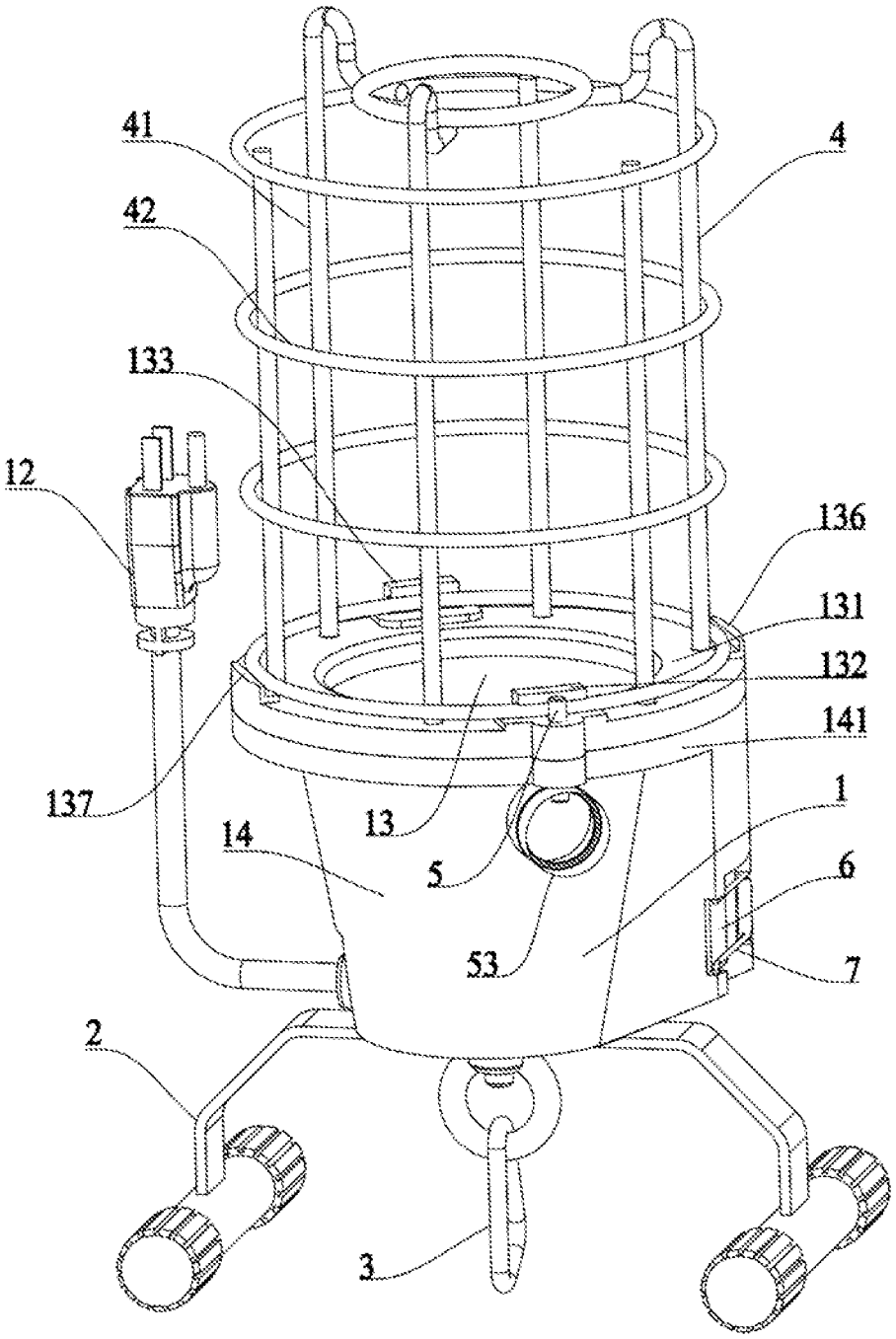
FIG. 1 is a schematic diagram of the structure of the multifunctional lamp in Embodiment 1 of the present patent.
Figure 2:
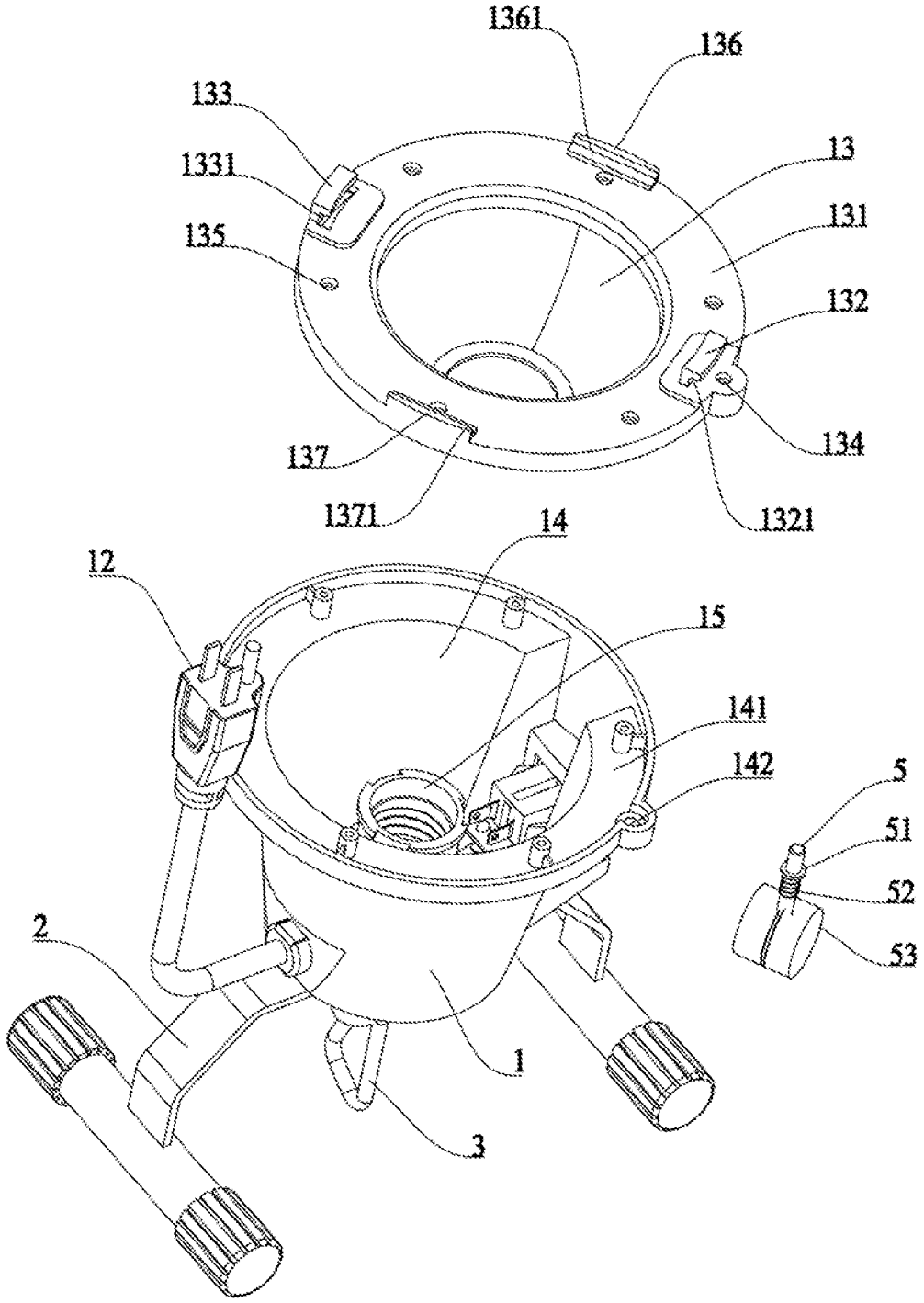
FIG. 2 is an exploded view of a part of the structure of the multifunctional lamp in Embodiment 1 of the present patent.
Figure 3:
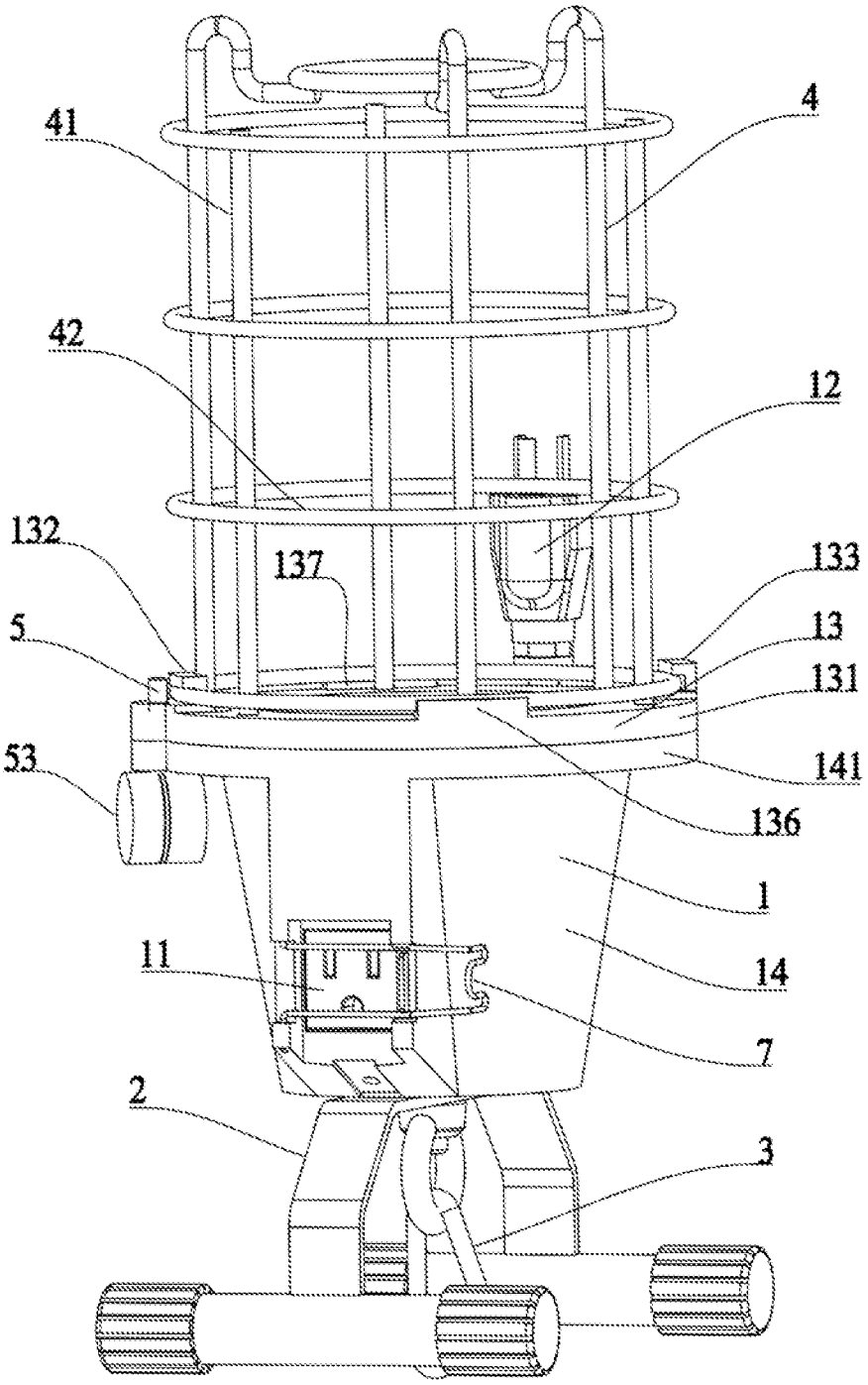
FIG. 3 is a schematic structural view of another aspect of the multifunctional lamp (hiding the dust cover on the socket) according to Embodiment 1 of the present patent.

A multifunctional lamp, as shown in FIG. 1~FIG. 3, which comprises a base 1, a luminous body (not shown in the figures) detachably connected to the base 1, and a supporting device 2 and a protective cover 4 respectively matched and connected to the base 1 (playing an anti-collision function, which can prevent foreign objects from damaging the luminous body). The base 1 is provided with a socket 11 and a plug 12, thus enabling the multifunctional lamp to be used as a linear lamp. A latch member is arranged between the base 1 and the protective cover 4. Through the supporting device 2, the multifunctional lamp can be placed on the ground, so that the multifunctional lamp can be used as a working lamp. Through the latch member, the base 1 and the protective cover 4 can be quickly disassembled and assembled.

The lamp of the present patent integrates the functions of a working lamp and a linear lamp, and has various functions. Further, as the luminous body and the base 1 are detachably connected, the user can replace different luminous bodies according to their preferences, with high flexibility. In addition, when the luminous body is damaged, only to replace the luminous body separately, and this saves cost. Apart from this, as the connection between the base 1 and the protective cover 4 adopts a latch structure, it is easy to disassemble and assemble, and is easy to operate.

The latch member is a cylindrical latch 5.

The base 1 includes a lampshade 13 and a bottom shell 14 matched and connected with the lampshade 13; the lampshade 13 is accommodated in the bottom shell 14; a lamp holder 15 is arranged inside the bottom shell 14; the lamp holder 15 is matched and connected with the lampshade 13; the luminous body is installed on the lamp holder 15.

The lamp holder 15 is a screw port holder; the screw port is an E26 screw port.

An upper cover plate 131 is provided on the top of the lampshade 13; a lower cover plate 141 is provided on the top of the bottom shell 14 corresponding to the upper cover plate 131; a first clamping block 132 and a second clamping block 133 are arranged in circumferential opposite directions on the upper cover plate 131; the first clamping block 132 is provided with a first clamping slot 1321; the second clamping block 133 is provided with a second clamping slot 1331; the opening direction of the first clamping slot 1321 faces away from the center of the upper cover 131; the opening direction of the second clamping slot 1331 faces the center of the upper cover plate 131; the protective cover 4 includes a number of support rods 41 arranged circumferentially, and a number of rings 42 that are matched and connected with the support rods 41; the bottom rings 42 are matched and clamped with the first clamping slot 1321 and the second clamping slot 1331; a first counterbore 134 is provided on the side of the opening of the first clamping slot 1321; the lower cover plate 141 corresponding to the first counterbore 134 is provided with a second counterbore 142; the cylindrical latch 5 passes through the first counterbore 134 and the second counterbore 142, blocking the bottom rings 42.

Through the above arrangement, the protective cover 4 can be firmly fixed to the base 1. In addition, in the process of replacing the luminous body, since the connection between the protective cover 4 and the base 1 adopts a cylindrical latch structure, it is easy to disassemble and assemble, and the operation is simple.

One end of the cylindrical latch 5 is provided with a stop ring 51; the top of the stop ring 51 is limited to the bottom of the first counterbore 134; one end of the spring 52 is limited to the bottom of the stop ring 51, and the other end is limited to the top of the second counterbore 142; the bottom of the cylindrical latch 5 is provided with an operating ring 53.

Through the above arrangement, the disassembly and assembly of the protective cover 4 and the base 1 is more convenient.

A plurality of limiting grooves 135 matched with the bottom of the supporting rod 41 are provided in the circumferential direction of the upper cover plate 131.

A first stop block 136 and a second stop block 137 matching to the bottom rings 42 are provided on the upper cover plate 131 in the circumferential direction. The first stop block 136 is provided with a first stop groove 1361. The second stop block 137 is provided with a second stop groove 1371.

Through the above arrangement, the connection between the protective cover 4 and the base 1 is more stable.

The socket 11 and the plug 12 are respectively arranged on both sides of the bottom shell 14. A dust cover 6 is arranged on the outside of the socket 11, serving the function of dust prevention.

A buckle 7 is provided on the outer side of the dust cover 6, to prevent falling off when the socket 11 is connected with the plug 12.

A hoisting device 3 and the supporting device 2 are respectively arranged on the bottom of the bottom shell 14.

The hoisting device 3 is a carabiner; and the supporting device 2 is a bracket. With the hoisting device 3, the multifunctional lamp can be hoisted.

The bracket is an inverted U-shaped bracket.

The method of disassembling and assembling of the protective cover 4 and the base 1 in the multifunctional lamp of this embodiment (as shown in FIG. 1~FIG. 3):

(1) When installing the protective cover 4, first pull down the operating ring 53, and the cylindrical latch 5 will move down accordingly. The opening of the first clamping slot 1321 is not blocked by the cylindrical latch 5 and is in an open state; then the bottom rings 42 of the protective cover 4 are clamped to the first clamping slot 1321 and the second clamping slot 1331, and is confined between the first stop groove 1361 and the second stop groove 1371; at the same time, adjust the position of the support rods 41, and align the bottom of the support rods 41 with the limiting grooves 135 so that it is limited in the limiting grooves 135; finally, release the operating ring 53, and the cylindrical latch 5 moves up accordingly. The opening of the first clamping slot 1321 is again blocked by the cylindrical latch 5 to complete the installation of protective cover 4 and base 1;

(2) When disassembling the protective cover 4, first pull down the operating ring 53, and the cylindrical latch 5 will move down accordingly. The opening of the first clamping slot 1321 is not blocked by the cylindrical latch 5 and is in an open state; then the remove the protective cover 4 from the first clamping slot 1321, the second clamping slot 1331, the first stopping groove 1361, the second stopping groove 1371, and the limiting grooves 135; finally, release the operating ring 53.

The method of using the multifunctional lamp in this embodiment:

(1) After installing the bracket, the multifunctional lamp of this embodiment can be used as a working lamp in a workshop, warehouse or large engineering site, and can be used in an inter-connected manner with a maximum of 20 sets;

(2) Under the premise of dismantling (or not dismantling) the support, it can be used by hoisting at the top of a building as needed.

The above description does not limit the present patent, and the present patent is not limited to the above examples. All changes, modifications, additions or substitutions made by those of ordinary skill in the art within the essential scope of the present patent shall also fall within the protection scope of the patent.

What is claimed is:

1. A multifunctional lamp, characterized by comprises a base (1), a luminous body detachably connected with the base (1), and a supporting device (2) and a protective cover (4) respectively matched and connected with the base (1); the base (1) is provided with a socket (11) and a plug (12); a quick disassembly and assembly structure is arranged between the base (1) and the protective cover (4);

the base (1) includes a lampshade (13) and a bottom shell (14) matched and connected with the lampshade (13); the lampshade (13) is accommodated in the bottom shell (14); a lamp holder (15) is arranged inside the bottom shell (14); the lamp holder (15) is matched and connected with the lampshade (13); the luminous body is installed on the lamp holder (15).

2. A multifunctional lamp of claim 1, characterized by the quick disassembly and assembly structure includes a latch member.

3. A multifunctional lamp of claim 2, characterized by the latch member is a cylindrical latch (5).

4. A multifunctional lamp of claim 3, characterized by an upper cover plate (131) is provided on the top of the lampshade (13); a lower cover plate (141) is provided on the top of the bottom shell (14) corresponding to the upper cover plate (131); a first clamping block (132) and a second clamping block (133) are arranged in circumferential opposite directions on the upper cover plate (131); the first clamping block (132) is provided with a first clamping slot (1321); the second clamping block (133) is provided with a second clamping slot (1331); the opening direction of the first clamping slot (1321) faces away from the center of the upper cover (131); the opening direction of the second clamping slot (1331) faces the center of the upper cover plate (131); the protective cover (4) includes a number of support rods (41) arranged circumferentially, and a number of rings (42) that are matched and connected with the support rods (41); the bottom rings (42) are matched and clamped with the first clamping slot (1321) and the second clamping slot (1331); a first counterbore (134) is provided on the side of the opening of the first clamping slot (1321); the lower cover plate (141) corresponding to the first counterbore (134) is provided with a second counterbore (142); the cylindrical latch (5) passes through the first counterbore (134) and the second counterbore (142), blocking the bottom rings (42).

5. A multifunctional lamp of claim 4, characterized by one end of the cylindrical latch (5) is provided with a stop ring (51); the top of the stop ring (51) is limited to the bottom of the first counterbore (134); one end of the spring (52) is limited to the bottom of the stop ring (51), and the other end is limited to the top of the second counterbore (142); the bottom of the cylindrical latch (5) is provided with an operating ring (53).

6. A multifunctional lamp of claim 4, characterized by a plurality of limiting grooves (135) matched with the bottom of the supporting rod (41) are provided in the circumferential direction of the upper cover plate (131).

7. A multifunctional lamp of claim 4, characterized by a first stop block (136) and a second stop block (137) matching to the bottom rings (42) are provided on the upper cover plate (131) in the circumferential direction; the first stop block (136) is provided with a first stop groove (1361); the second stop block (137) is provided with a second stop groove (1371).

8. A multifunctional lamp of claim 1, characterized by the socket (11) and the plug (12) are respectively arranged on both sides of the bottom shell (14); a dust cover (6) is arranged on the outside of the socket (11).

9. A multifunctional lamp of claim 8, characterized by a buckle (7) is provided on the outer side of the dust cover (6).

10. A multifunctional lamp of claim 1, characterized by a hoisting device (3) and the supporting device (2) are respectively arranged on the bottom of the bottom shell (14); the hoisting device (3) is a carabiner; and the supporting device (2) is a bracket.

* * * * *